United States Patent [19]

Egri

[11] 3,986,515

[45] Oct. 19, 1976

[54] PROCESS FOR THE PRODUCTION OF SMOKABLE PRODUCTS

[75] Inventor: Laszlo Egri, Basel, Switzerland

[73] Assignee: Tamag Basel AG, Birsfelden, Switzerland

[22] Filed: Dec. 18, 1974

[21] Appl. No.: 533,779

[30] Foreign Application Priority Data

Dec. 20, 1973 Germany ..... 2363640

[52] U.S. Cl. ..... 131/140 C

[51] Int. Cl.[2] ..... A24B 15/06

[58] Field of Search ..... 131/17, 140 C, 136, 131/138, 145, 2, 17 R

[56] References Cited

UNITED STATES PATENTS 3,628,541 12/1971 Buchmann et al. ..... 131/140 C 3,894,544 7/1975 Egri et al. ..... 131/140 C

*Primary Examiner*—Robert W. Michell

*Assistant Examiner*—V. Millin

*Attorney, Agent, or Firm*—Hubbell, Cohen, Stiefel & Gross

[57] ABSTRACT

Reconstituted tobacco product and process of making same. Process comprises disposing a mist, tobacco-containing mass on a transport surface, compressing the moist mass between the transport surface and a counterpart surface to form a substantially flat sheet, pressing the moist flat sheet with an element having separating forms so as to partially separate the sheet into essentially individual leaf-shaped members, removing the members from the transport surface, and drying the members to a desired final moisture content.

23 Claims, 5 Drawing Figures a)

b)

PROCESS FOR THE PRODUCTION OF SMOKABLE PRODUCTS

Figure 1:
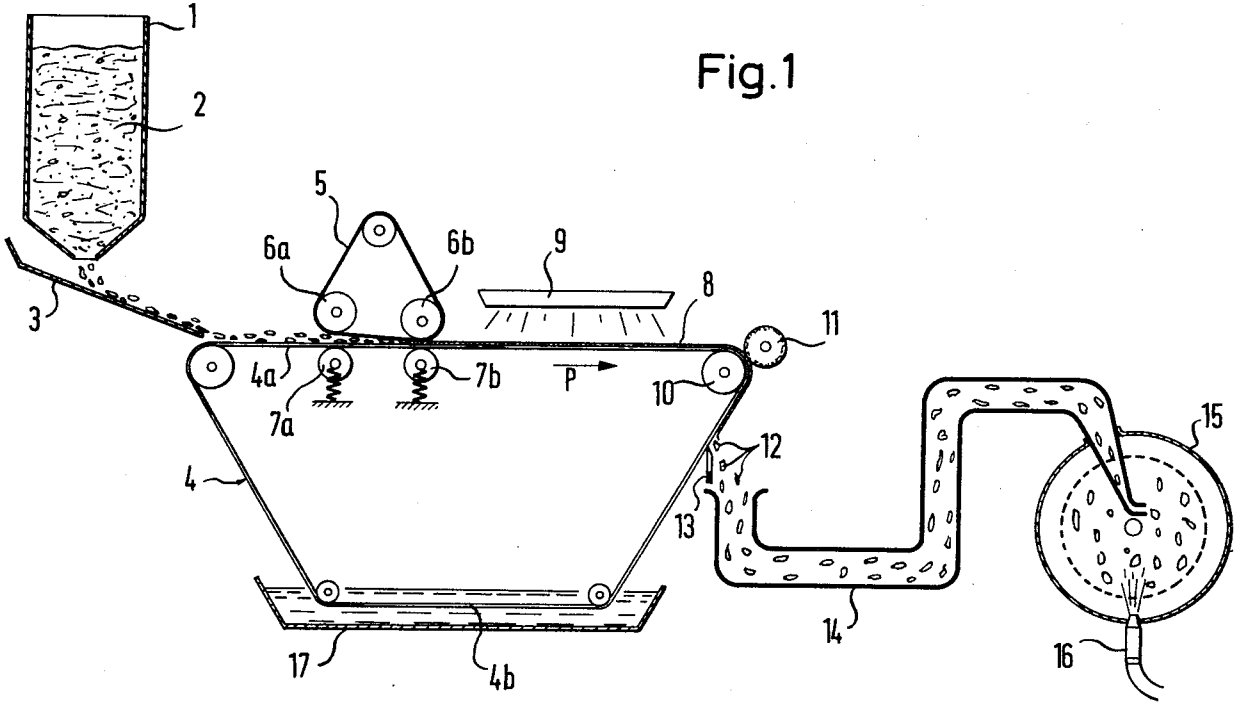

This invention relates to smokable, substantially homogeneous flake-like or leaf-like products of approximately equal thickness and containing tobacco and/or tobacco substitute. Moreover, this invention relates to a process for the production of such products and a device for carrying out the process.

In a known process for producing the afore-cited smokable products, coarsely comminuted tobacco materials, in particular ribs and wastes, are admixed with a small amount of liquid and kneaded. The resultant crumbly, moist mass is then subsequently pressed at a pressure in excess of 101 kg/cm$^2$ to form flakes. These are tobacco structures of large surface area which must be recut subsequently to the sizes necessary to be added to cigar fillers or to cigarette tobacco. The flakes produced during this process are flat like paper and only a low filling capacity. The mechanical expenditure for achieving the high pressures and the consumption of energy required during pressing or rolling is high. Furthermore, the subsequent cutting operation is also disadvantageous because the knives are subject to a high amount of wear which necessitates frequent replacement of the knives.

Another process is known in which the starting products are ground very fine in size, in part even in colloidal size, and are admixed with large amounts of liquid. The thin slurry obtained according to this process known as the slurry process is then measured out in a thin layer on a drying belt and is dried to form a foil. Insofar as this foil is supposed to be used as a filler for cigars or cigarettes, it must be cut again subsequently hereto. Although no pressure is employed in this process, the consumption of energy is nevertheless very high because large amounts of liquid must be removed from the mass. In addition, the above-mentioned difficulties again arise when the foil is cut. Furthermore, this process produces a thin paper-like product with a low filling capacity.

Up to now the dried, band-like foils were generally cut longitudinally and transversely into large pieces at the end of the transport belt by cutting devices (Swiss Pat. No. 530,174, column 6, line 57). This cutting causes a relatively great amount of wear to the cutting knives, in particular in the case of artificial tobaccos which contain greater amounts of inorganic additives.

A suggestion has recently been revealed by U.S. Pat. 3,713,358 which intends avoiding the disadvantages of the afore-cited process. In so doing, special reference is made to the corrosion problems when cutting the finished foils into large pieces as is common nowadays. This suggestion proposes cutting the flexible foils at 8 – 12% the moisture content subsequent to leaving an endless belt by means of a plurality of parallel knives and belt devices to form pieces in the shape of a parallelogram. The great amount of wear of the cutting knives and the resultant frequent sharpening of the same are not eliminated by this proposal. Furthermore, the pieces produced in this manner attract attention in an undesirable way due to the uniform regular geometrical shapes and the resultant unnatural appearance between the natural tobaccos. In addition, they have a paper-like shape, but do not have good filling capacity as is also the case in the afore-cited artificial structures.

The object of the invention is primarily to produce smokeable, substantially homogeneous flake-like or leaf-like products of approximately equal thickness and containing tobacco and/or tobacco substitute.

A further object consists in providing a process for producing smokable products of the afore-stated type, which permits flake-like or leaf-like tobacco products with a good filling capacity to be made with a low expenditure of energy and low cost of construction.

The subject matter of the invention is thus smokable products of the afore-cited type which are characterized by an irregularly wavy configuration, irregular dimensions with substantially non-rectilinear edges, by visible porous properties and by a high filling capacity when used as cigar and/or cigarette filler and by the same color on both sides.

In particular, the subject matter of the invention is smokeable products of the afore-cited type which are characterized in that they have an irregularly wavy configuration, irregular dimensions with substantially non-rectilinear edges and visible porous properties, a high filling capacity when used as cigar or cigarette filler as well as the same color on both sides and are obtainable by deforming a moist mass containing tobacco and/or tobacco substitutes between a rotating transport surface and a counterpart surface to form a flat structure, by pushing apart the flat structure located on the transport surface and not yet dried to its final moisture content and being in a plastic state into flake or leaf shape by means of an element provided with separating forms in a squeezing operation for separation purposes and by removing the structures from the transport surface immediately thereafter and drying them to their final moisture content.

The subject matter of the invention is also a process for producing smokable, flake-like or leaf-like products containing tobacco and/or tobacco substitute, in which a tobacco and/or a moist mass containing tobacco and/or tobacco substitutes is deformed and dried between a rotating transport and counterpart surface to form a flat structure and is brought into flake or leaf shape, which is characterized in that the flat structure located on the transport surface and not yet dried to its final moisture content and being in a plastic state is pushed apart by means of an element provided with separating forms during a squeezing operation to separate said structure in flake or leaf shape, is immediately removed thereafter from said transport surface and is dried to the final moisture content.

In the inventive process, the flakes or leaves are produced in their area size on the transport surface. In doing so, the mass which has a moisture content higher than said final moisture content is deformed to the desired size by the separating forms. This is not a cutting operation in the conventional sense so that the squeezing ridges of the separating are may be relatively dull and are therefore only subject to negligible wear. When the flakes or leaves, which are shaped in this way and are peeled off the transport surface while still in a moist state are dried, they deform and warp to form irregular three-dimensional structures with an extraordinarily large filling capacity. The inventive process may be carried out in a small device with a low expenditure of energy, for it is not necessary to compress the mass at high pressure to form a firmly coherent foil because it is separated to form flakes or leaves before it is removed from the transport surface.

It is expedient in many cases to pre-dry the flat structure on the transport surface, preferably by about 5% calculated on the basis of the weight of the moist mass. This pre-drying facilitates removing the flakes or leaves from the transport surface to a considerable extent. Apparently a crusted surface which prevents the flakes or leaves from sticking together when they are scraped off the transport surface is formed during the drying operation on one side. This is the case when radiant heat is used for pre-drying.

Particularly good results are obtained if the drying of the flakes or leaves to their final moisture content takes place in a suspended state by means of a gas passing on all sides of the flakes or leaves. By drying the flakes or leaves in a suspended state, in which all surfaces are in contact with the drying gas, a very low amount of energy is consumed during drying. In addition it has been shown that the flakes or leaves deform to a particularly great extent to form three-dimensional structures when they are dried freely suspended and not in contact with a surface. In this respect drying in a suspended state also improves the filling capacity of the flakes or leaves which achieve their final shape and size during the drying operation.

The tendency of the leaves or flakes to undergo irregular spacial deformation may be improved by pushing them apart by means of separating forms of irregular contour, separating forms being preferably used which have serrated squeezing ridges.

In the known slurry processes it was necessary to wash the starting product with large amounts of water prior to production of the tabacco mass or to grind it again in a moist state after dry grinding. Only in this way has it been possible to impart sufficient bonding capacity to the mass. If the operation was carried out with a mass of relatively low moisture content, very high pressure of 101 kg/cm$^2$ and more were employed to obtain sufficient coherence of the reconstituted tobacco foil. The initial washing operation means a great expenditure of washing liquid whose elimination is problematical in a dirty state. High pressures and much liquid in the mass produce a high expenditure of energy during the production of pressure or when drying the mass.

Another object of the invention is therefore to provide a process for producing reconstituted tobacco-containing structures, in which the result is achieved without costly washing or rinsing operations and with a low consumption of energy. This object is accomplished in accordance with the invention in that the mass is admixed with a wetting agent prior to being deposited on the transport surface.

A surprising result has been that by using a wetting agent the starting products may be produced without thorough washing and coherent structures may be produced without the application of high pressure from the mass which contains only coarsely ground tobacco particles and which has been admixed with slight amounts of liquid. Apparently, the wetting agent increases the bonding capacity of the tobacco particles to such an extensive degree that a sufficiently coherent layer can be produced on the transport surface without washing as well as at a low pressure and with little liquid and flakes or leaves may be produced with a resistance of tearing which is sufficient for all practical purposes. The use of a wetting agent is also advantageous if the reconstituted tobacco structure is produced according to any other arbitrary process, for example the slurry process.

The wetting agents predominantly include special wetting agents such as higher alcohols, sulfonated alcohols, sulfonated ether, lauryl sulfate, silicon, polyglycol ester and polyglycol ether or natural wetting agents such as saponins. Such special wetting agents only need to be added in slight amounts to the mass, for example approx. 0.1 – 2% calculated on the basis of the dry mass.

An adequate effect is also achieved however if the substances which are normally mixed with the tobacco as moisture retention agents are used as the wetting agent. In this case, however, it is necessary to increase the amount of the admixed agents to at least approximately one and a half times the amount common in the case of moisture retention agents. Wetting agents within this meaning can be considered to be sorbitol, diethylene glycol and glycerin as well as other conventional moisture retention agents. They are used in an amount of approx. 6 to 10% based on the dry mass.

If conventional moisture retention agents are employed as wetting agents such that they are admixed with the comminuted tobacco together with the liquid instead of with the finished product, a sufficient wetting effect with correspondingly good bonding capacity and low processing pressure is attained even if the amounts which are common in the case of moisture retention agents are not exceeded.

Admixing the wetting agent at the beginning of the process is also advantageous when special wetting agents are used because the bonding capacity is increased and the processing pressure is decreased.

In addition, mixtures of the afore-mentioned wetting agents may be used in the inventive process.

The following are examples for the inventive process:

EXAMPLE 1:

75 g of tobacco parts which are comminuted down to a grain size of 200 $\mu$ and consisting of 35 g of Burley ribs and 30 g of tobacco dust are mixed well with 70 ml of water, 0.2 ml of saponin, 5 ml of diethylene glycol, 1 ml of glyoxal and 7 g of carboxymethyl cellulose. To this moist mass are subsequently added 5 g of Mg-Al-silicate, 2 g of citric acid, 1 g of $TiO_2$ and 4 g of dextrin. This mass is deformed between two belts to form a coherent foil of about 0.1 mm thickness and is comminuted at a moisture content of 40% by means of deformation rollers to form pieces similar to tobacco leaves, is scraped off the plastic belt and is dried in a suspended state to about 15% moisture content.

EXAMPLE 2:

70 g of comminuted tobacco components, 10 g of one or more vegetable substances, e.g. sawdust, rye, wheat or maize husks are mixed well with 80 ml of water, 7 ml of diethylene glycol, 1 ml of glyoxal and 6 g of carboxymethyl cellulose. 2 g of citric acid, 1 g of $TiO_2$ and 3 g of silicic acid are admixed to this moist mass and the process is continued as stated in Example 1.

EXAMPLE 3:

75 g of comminuted tobacco parts (grain size to approx. 150 $\mu$m) consisting of 30 g of air-cured Rio Grande ribs, 30 g of coal slack below 6 mm contained in loaded lumps and 15 g of tobacco dust are mixed well with 80 ml of water, 5 ml of diethylene glycol, 2 g of potassium silicate at pH 8 and 6 g of methyl cellulose. 3 g of magnesium-aluminum silicate and 3 g of starch are subsequently admixed to this moist mass. Further processing takes place as in Example 1.

An inventive device for carrying out the process is characterized by a transport belt, an application and dosing means for uniformly applying the mass on the transport belt, a counterpart belt which runs in the same direction but slower than the transport belt and serves to spread the mass on said transport belt, a shredding roller which rotates in contact with the transport belt adjacent a counterpart roller and upon whose peripheral surface projecting squeezing ridges are provided which form closed separating forms on said periphery, a scraper disposed downstream of said shredding roller and a dryer for receiving the leaves or flakes coming from said scraper.

Such a device is constructed at low construction costs and has a high output with minimum space requirements as compared to very large conventional installations.

Figure 2:
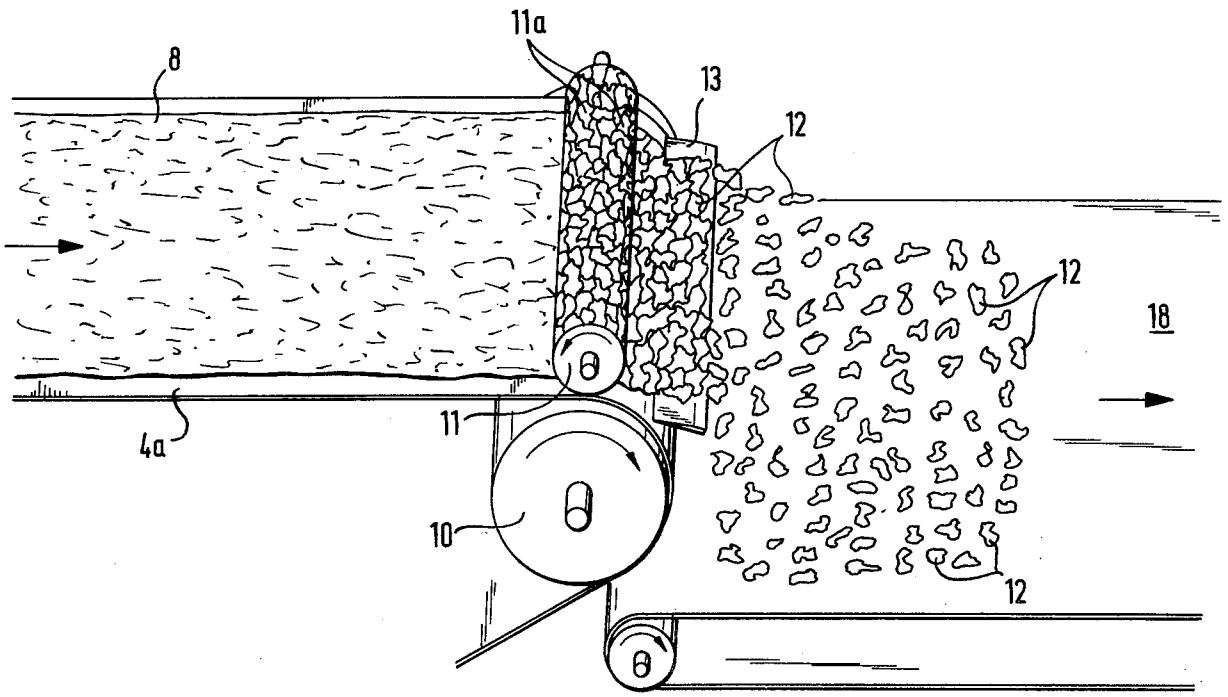
Figure 3:
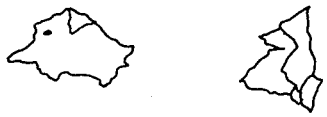
Figure 3:
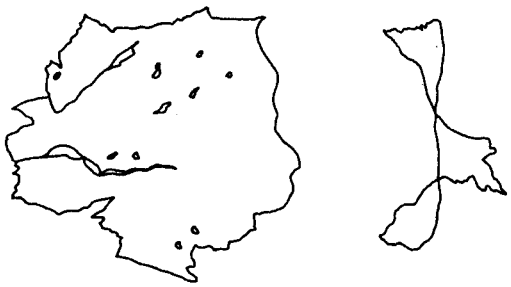

The invention will be described hereinbelow in more detail with reference to the drawing in which FIG. 1 shows an embodiment of a device for carrying out the inventive process in a highly schematic illustration and FIG. 2 shows a detail of a device which is somewhat modified as compared to FIG. 1. The inventive products are illustrated in front and lateral elevations in FIG. 3, FIG. 3*a* showing a product preferably used as a cigar filler and FIG. 3*b* showing a product preferably used as a cigarette filler.

Ribs, wastes and stems of tobacco or possibly from other plant substances which can be used for smoking purposes are used as the starting material.

The starting material is adjusted to a moisture content of about 12 – 15% by pre-drying. It is then ground coarsely by means of conventional means, e.g. in a hammer mill. The starting material is comminuted so that about 80% of the particles have a size from 150–200 $\mu$, 10% have a particle size in excess of 200 $\mu$ and 10% have a particle size below 150 $\mu$.

The starting materials may be mixed after comminution in order to obtain special tastes. Moreover, additives such as glue, adsorbents and burn promoters are admixed thereto in the conventional amount and quality.

Apart from that, moisture retention agents and wetting agents for softening are dissolved in water. Sorbitol, diethylene glycol and glycerin must be taken into consideration as moisture retention agents for example. As moisture retention agents, these substances are normally admixed in amounts of about 4 – 5% calculated on the basis of the dry mass. This amount must be approximately doubled if they are supposed to function as softeners simultaneously.

Special wetting agents such as higher alcohols, sulfonated alcohols or sulfonated ether, lauryl sulfate, silicone, polyglycol ester or polyglycol ether and preferably suitable saponins may also be dissolved in water in an amount of about 0.1 – 2% for softening.

The tobacco particle mixture provided with the additives is then admixed with the solution containing the moisture retention and wetting agents, the ratio of dry mass: water being adjusted according to the type and sort of tobacco such that a kneadable mass is produced. The dry substances are mixed with the solution either discontinuously in a planetary-type mixer or continuously in a conventional high-speed mixer. Subsequent kneading is advisable when mixing was not particularly intensive.

A crumbly tacky mass is formed which is filled into a reservoir 1 which is shown in FIG. 1 and is designed by number 2 in the drawing. The mass 2 is measured out onto a transport belt 4 expediently consisting of plastic by means of a dosing means 3 such that the mass is uniformly distributed over the work leg 4*a* of the transport belt in a layer approx. 1 – 2 mm thick.

The work leg 4*a* of the transport belt 4 is associated with a counterpart belt 5 which is conducted about lower guide rollers 6*a*, 6*b*. The guide roller 6*a* is spaced about 0.5 – 1 mm from the surface of the work leg 4*a* when the device is not loaded whereas the roller 6*b* is disposed such that the counterpart belt 5 just touches the work leg 4*a* also while the device is not loaded. The work leg 4*a* is supported by support rollers 7*a*, 7*b* beneath the guide rollers 6*a*, 6*b*. As indicated in the drawing, the support rollers 7*a*, 7*b* are mounted so as to be resilient in a downward direction due to spring action. They can therefore yield downwardly when the mass is introduced into the gap between the counterpart belt 5 and the transport 4 which tapers conically in the direction of travel P.

The counterpart belt 5 which also expediently consists of plastic also runs slower than the transport belt.

The mass issues from the gap between the two belts as a uniformly thick foil 8 whose thickness is dependent on the afore-mentioned gap width. The deformation of the mass 2 to form the foil 8 occurs in the gap between the belts 4 and 5 at a relatively low pressure of 20 kg/m$^2$ for example. The belt 5 has in fact more of a spreading than a compressing function.

The squeezing process and removal from the transport surface is advantageously carried out when the moisture content of the mass amounts to about 30 – 60%, in particular about 35 – 55%.

The foil 8, which still lies on the work leg 4*a* of the transport belt 4, is expediently pre-dried, the use of a radiant heater 9 being especially suitable to this end. The pre-drying is intended to reduce the moisture content to approximately 5% calculated on the basis of the total mass.

A shredding roller 11 is associated with the work leg 4*a* adjacent a guide roller 10 which conducts the transport belt 4. As can be seen in more detail in FIG. 2, this shredding roller consists of plastic and has relatively dull squeezing ridges 11*a* on its surface which, as can be seen clearly in FIG. 2, define closed areas of irregular configuration and are expediently serrated. The squeezing ridges abut lightly on the work leg 4*a* and push the foil-shaped tobacco mass 8 apart such that flakes or leaves of irregular contours remain adhering to the belt 4. These are not cut apart directly, but rather still have a certain amount of cohesion at individual locations. These flakes or leaves 12 are scraped off the belt 4 by a knife 13 immediately after squeezing according to FIG. 1 and fall into a pneumatic passageway 14. During th scraping operation and pneumatic transport, they separate completely from one another and may then be blown into a dryer as discrete particles. In FIG. 1, a drum dryer 15 is shown in which the flakes or leaves 12 are dried in a freely suspended state by warm air expelled from a nozzle 16. The drum dryer 15 includes a housing with a rotating sieve drum. The particles to be dried are introduced adjacent the center of the rotating sieve drum. Any other dryer in which the flakes or leaves have access to a drying gas from all sides may be used for the drying process. For instance, cyclone dryers or pneumatic suspension dryers may be used.

The return leg 4*b* of the transport belt 4 is cooled by tap water in a cooling pan 17.

The illustration according to FIG. 2 deviates somewhat from that according to FIG. 1 in that in this illustration the individual flakes 12 fall onto a transport belt 18 after having been scraped off by the knife 13. This transport belt then conducts them to a suspension dryer (not shown).

The squeezing ridges 11*a* of the shredding roller 11 are disposed and dimensioned such that the flakes or leaves 12 already have the desired final size. This amounts to about 2–4 $cm^2$ in the case of flakes to be used as cigar filler and about 30 – 50 $cm^2$ in the case of flakes to be used as cigarette filler. The thickness of the flakes amounts to about 0.08 – 0.12 mm. The resultant flakes or leaves 12 have an irregular peripheral shape with a wavy edge and are spacially distorted and warped thus producing a large filling capacity. The cigar flakes are admixed directly with the filler, whereas the cigarette leaves, after having been admixed with leaf tobacco, is again cut together with this leaf tobacco in the conventional manner.

The invention is not restricted to the embodiment shown. For example, the foil 8 may also be formed on a rotating drum. The mass may also be applied directly to the dosage means 3 through a perforated plate of a kneading machine in place of a reservoir 1.

What is claimed is:

1. A process for making a smokable, flake-like, or leaf-like reconstituted tobacco product comprising a. disposing a moist, tobacco-containing mass on a rotating transport surface, b. deforming said mass to a moist, substantially flat sheet by compressing said mass between said rotating transport surface and a counterpart surface, c. pressing said moist flat sheet, while it is in a plastic state and before it has been dried to a final moisture content, with an element provided with separating forms so as to partially separate and push apart the moist plastic sheet into essentially individual flake-shaped or leaf-shaped members, d. removing said members from the transport surface, and e. subsequently drying said members to a final moisture content.

2. A process according to claim 1, wherein the mass is softened before being applied to the transport surface.

3. A process according to claim 2, wherein the mass is softened by making it basic, with a silica sol.

4. A process according to claim 1, wherein the flat structure is pre-dried on said transport surface.

5. A process according to claim 4, wherein the moisture content is reduced during pre-drying by approximately 5%, calculated on the basis of the weight of moist mass.

6. A process according to claim 5, wherein pre-drying is carried out by means of radiant heat.

7. A process according to claim 1, wherein the flakes or leaves are dried to their final moisture content in a suspended state by flowing a gas around the flakes or leaves on all sides.

8. A process according to claim 1, wherein the flakes or leaves are partially separated and pushed apart by means of separating forms of irregular contour.

9. A process according to claim 8, wherein the flakes or leaves are pushed apart by separating forms having serrated squeezing ridges.

10. A process according to claim 1, wherein the mass is admixed with a wetting agent in order to soften said mass prior to being deposited on the transport surface.

11. A process according to claim 10, wherein the wetting agent is a synthetic wetting agent or a natural wetting agent.

12. The process of claim 11 wherein the synthetic wetting agent is a higher alcohol, a sulfonated alcohol, a sulfonated ether, lauryl sulfate, a silicone, a polyglycol ester, or a polyglycol ether and wherein the natural wetting agent is saponin.

13. A process according to claim 11, wherein the wetting agent is added in an amount of approximately 0.1 – 2% calculated on the basis of the dry mass.

14. A process according to claim 10, wherein the wetting agent is a moisture retention agent.

15. The process of claim 14 wherein the moisture retention agent is sorbitol, diethylene glycol, or glycerin.

16. A process according to claim 14, wherein the wetting agent is used in an amount of approximately 6 – 10% calculated on the basis of the dry mass.

17. A process according to claim 10, wherein the wetting agent together with liquid is admixed directly with the tobacco containing mass.

18. A process according to claim 17, wherein the mass is mixed with liquid in such amount that the resultant mass exhibits a crumbly tacky consistency, and wherein said mass is deformed by compressing it under a slight pressure.

19. The process of claim 18 wherein said pressure is about 20 $kg/cm^2$.

20. A process according to claim 1, wherein the transport and the counterpart surfaces comprise of plastic belts.

21. A process according to claim 1, wherein the squeezing operation and removal from the transport surface are carried out when the moisture content of the mass amounts to approximately 30 – 60%.

22. The process of claim 21 wherein said moisture content is approximately 35%–55%.

23. The product of the process of claim 1.

* * * * *